US005491946A

United States Patent [19]

Landis et al.

[11] Patent Number: 5,491,946

[45] Date of Patent: Feb. 20, 1996

[54] WIDE DECKING STRUCTURE

[76] Inventors: Donald H. Landis, 308 Hermitage Dr.; David F. Landis, 50 Holland Rd., both of Pittsburgh, Pa. 15235

[21] Appl. No.: 844,150

[22] Filed: Mar. 2, 1992

[51] Int. Cl.[6] ..... E04B 1/38

[52] U.S. Cl. ..... 52/336; 52/450; 52/452; 52/453

[58] Field of Search ..... 52/336, 220.4, 52/222, 450, 452, 453

[56] References Cited

U.S. PATENT DOCUMENTS

| | | | |
|---|---|---|---|
| 3,397,497 | 8/1968 | Shea et al. | 52/450 |
| 3,462,902 | 8/1969 | Albrecht et al. | 52/336 X |
| 3,608,263 | 9/1971 | Gartner | 52/336 X |
| 4,074,495 | 2/1978 | Bodnar | 52/630 X |
| 4,675,238 | 6/1987 | Karoubas | 52/450 X |

*Primary Examiner*—Kien T. Nguyen
*Attorney, Agent, or Firm*—Ansel M. Schwartz

[57] ABSTRACT

The present invention pertains to a long-span decking panel. The long-span decking panel is used, for instance, to span the space between girders to create a roof or a composite floor. The panel has a flange member having a first edge and a second edge. The edges are at least 11 inches apart. The flange member defines an essentially flat unbroken soffit except for a series of stiffening ribs running transverse to the edges. The stiffening ribs provide sufficient rigidity to the flange member to prevent it from buckling along its length. The long-span decking panel also has a first web member which is integrally jointed and extending obliquely form the first edge. There is also a second web member integrally joined and extending obliquely from the second edge. The web members can be of any desirable length depending on the decking situation. There is a first seated end extending from the first web member in a parallel relationship with the flange member and a second seated end extending from the second web member in a similar parallel relationship with the flange member. The seated ends are adapted for the decking to rest upon. The present invention also pertains to a plated decking structure. The decking structure has at least one, but preferably more than one, long-span decking panel. The long-span decking panels are of similar construction and innovation as previously described. (i.e. the flange is wider than normal and is supported by only a series of transverse stiffening ribs). A base plate is provided upon which the first and second seated ends are fixedly attached.

9 Claims, 3 Drawing Sheets

WIDE DECKING STRUCTURE

FIELD OF THE INVENTION

The present invention is related to a long-span decking panel. More specifically, the present invention is related to a wide long-span decking panel of simple construction for use with roofs and composite floors.

BACKGROUND OF THE INVENTION

In the past, long-span decking panels have been manufactured in single cell profiles of 12-inch wide units. It is known to weld two single cells to plates to provide a 24-inch coverage width. The width of single long-span decking panels has been effectively limited to 12 inches due to the increasing tendency of the flange member to collapse under the load it is carrying as its width is increased.

Panel widths over 12 inches and up to 30 inches have been achieved by Planja, Inc. of Stockholm, Sweden. Planja accomplishes this by incorporating microembossing, transverse embossing, and lateral grooves. Unfortunately, these strengthening features require numerous manufacturing processes which contribute to the complexity and expense of the panel formation process.

The present invention provides a single long-span decking panel having a flange capable of spanning a width of over 10.5 inches having a simpler construction than previous known long-span decking panels. The present invention has an essentially flat soffit except for a series of stiffening ribs. By making these stiffening ribs the proper depth, this greater width with proper structural support is achieved without the need of microembossing or lateral grooves.

SUMMARY OF THE INVENTION

The present invention pertains to a long-span decking panel. The long-span decking panel is used, for instance, to span the space between girders to create a roof or composite floor. The panel has a flange member having a first edge and a second edge. The edges are at least 11 inches apart. The flange member defines an essentially flat unbroken soffit except for a series of stiffening ribs running transverse to the edges. The stiffening ribs provide sufficient rigidity to the flange member to prevent it from buckling along its length. The long-span decking panel also has a first web member which is integrally jointed and extending obliquely form the first edge. There is also a second web member integrally joined and extending obliquely from the second edge. The web members can be of any desirable length depending on the decking situation. The web members can also have stiffening ribs running transverse to the edges of similar spacing and dimensions to the stiffening ribs in the top flange member. There is a first seated end extending from the first web member in a parallel relationship with the flange member and a second seated end extending from the second web member in a similar parallel relationship with the flange member. The seated ends are adapted for the decking to rest upon.

The present invention also pertains to a decking structure. The decking structure has at least one, but preferably more than one, long-span decking panel. The long-span decking panels are of similar construction and innovation as previously described (i.e. the flange is wider than normal and is supported by only a series of transverse stiffening ribs). A base plate is provided upon which the first and second seated ends are fixedly attached. The base plate has a third edge having a first projection extending therefrom and a fourth edge having a second projection extending therefrom for engaging with a first projection of an adjacently disposed base panel. Preferably, the first projection defines a bent lap and the second projection defines a strip for engaging within the bent lap. The base plate can have stiffening ribs running transverse to the edges of similar spacing to the stiffening ribs in the top flange member.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
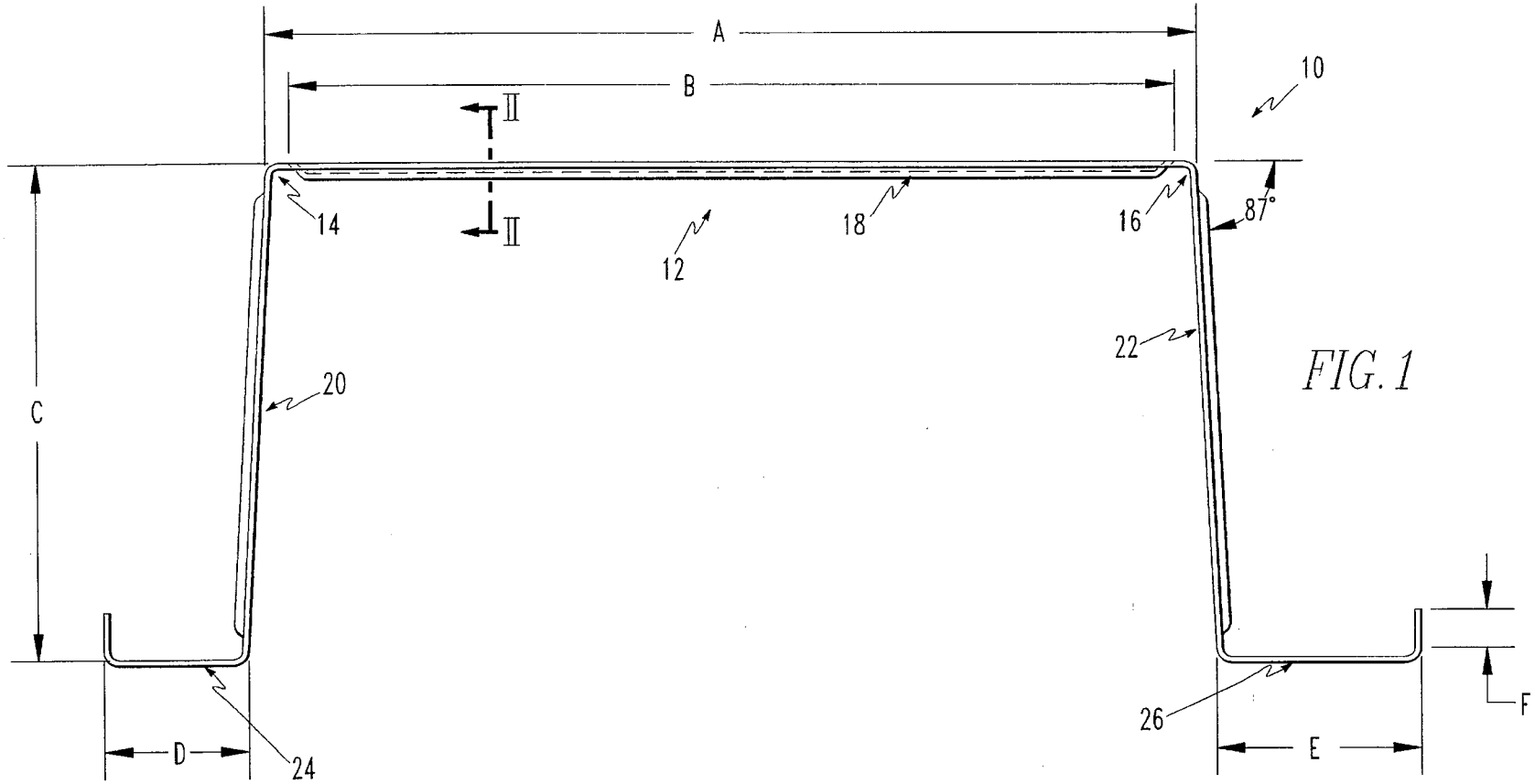
FIG. 1 is a schematic representation showing a side view of the long-span decking panel.

Referring now to the drawings wherein like reference numerals refer to similar or identical parts throughout the several views, and more specifically to FIG. 1 thereof, there is shown a long-span decking panel 10. The long-span decking panel 10 is used, for instance, to span the space between girders to create a roof, but can also be used as the base structure for a composite floor. The panel 10 has a flange member 12 having a first edge 14 and a second edge 16. The edges 14, 16 are at least 11 inches apart. The flange member 12 defines an essentially flat unbroken soffit except for a series of stiffening ribs 18 running transverse to the edges 14, 16. The stiffening ribs 18 provide sufficient rigidity to the flange member 12 to prevent it from buckling along its length. The long-span decking panel 10 also has a first web member 20 which is integrally jointed and extending obliquely from the first edge 14. There is also a second web member 22 integrally joined and extending obliquely from the second edge 16. The web members 20, 22 can be of any desirable length depending on the decking situation. There is a first seated end 24 extending from the first web member 20 in a parallel relationship with the flange member 12 and a second seated end 26 extending from the second web member 22 in a similar parallel relationship with the flange member 12. The seated ends 24, 26 are adapted for the decking to rest upon. Preferably, the first seated end 24 has a smaller width (represented as reference character D in FIG. 1) than the width (E) of the second seated end 26 so that it can seat and engage within a second seated end 26 of an adjacent panel member 12. In this manner, a plurality of panel members can be lockingly engaged along their length to form, for instance, a structurally sound roof or composite floor. As a roof insulation and an exterior weather tight cover would be placed on the decking. As a composite floor, concrete is poured over the decking.

Figure 2:
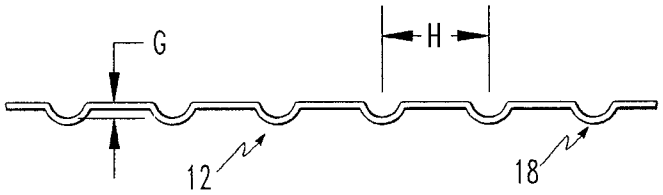
FIG. 2 is a schematic representation showing a cross section 2—2 from FIG. 1.

In a preferred embodiment, and as shown in FIG. 2, the ribs 18 are rolled into the flange 12 at a spacing (H) of 1.5 inches. To provide the necessary rigidity to support the relatively wide flange 12, preferably, the ribs 18 are at least ⅛ inches deep and preferably 3/16 inches deep. Preferably, the first and second web members 20, 22 extend from the flange member 12 at an angle of 87°, as shown in FIG. 1.

Figure 3:
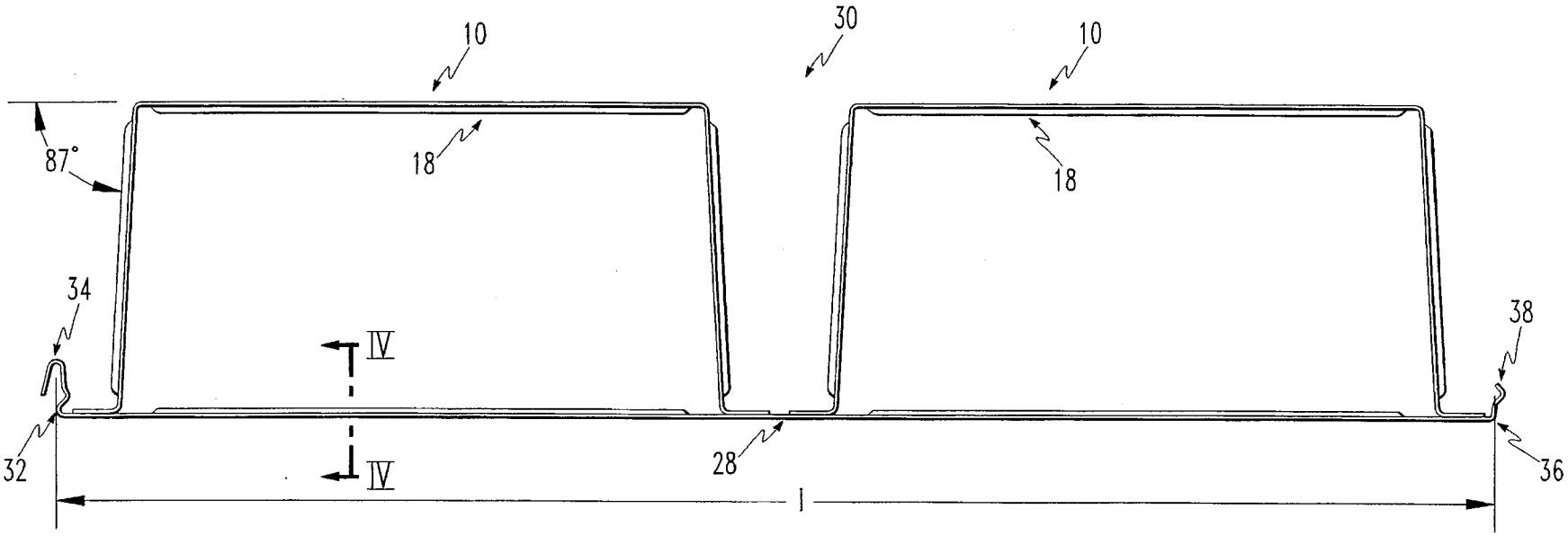
FIG. 3 is a schematic representation showing the decking structure .

In an alternative embodiment, and as shown in FIG. 3, a decking structure 30 is described. The decking structure 30 has at least one, but preferably more than one, long-span decking panel 10. The long-span decking panels 10 are of similar construction and innovation as previously described. (i.e. the flange is wider than normal and is supported by only a series of transverse stiffening ribs 18). A base plate 28 is provided upon which the first and second seated ends 24, 26 are fixedly attached. The base plate 28 has a third edge 32 having a first projection 34 extending therefrom and a fourth edge 36 having a second projection 38 extending therefrom for engaging with a first projection of an adjacently disposed base panel 28. Preferably, the first projection 34 defines a bent lap and the second projection 38 defines a strip for engaging within the bent lap. The base plate shall have stiffening ribs running transverse to the edges of similar spacing to the stiffening ribs in the top flange member. In this manner, the decking structure 30 can be used to cover relatively large widths and can be interconnected with other decking structures to ensure proper spacing and structural integrity.

Figure 4:
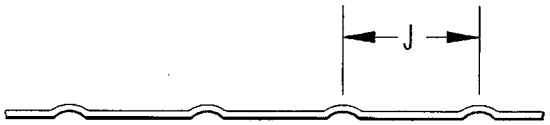
FIG. 4 is a schematic representation showing a cross section 4—4 from FIG. 3.
Figure 5:
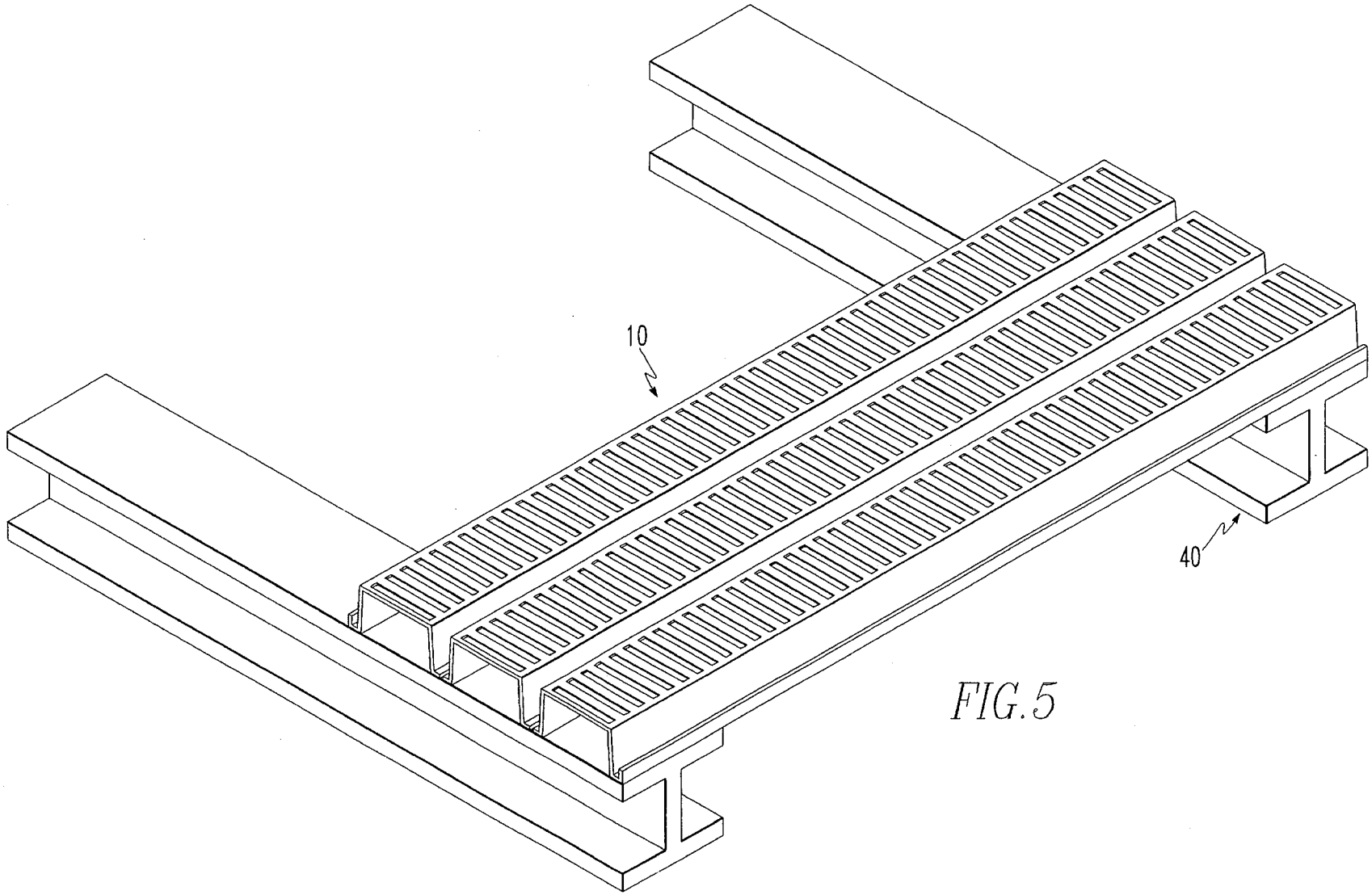
FIG. 5 is a schematic representation showing long-span decking panels forming a roof or base for a composite floor between girders.

In the operation of the invention and as shown in FIG. 4, a plurality of long-span decking panels 10 are screwed or welded onto girders 40 side by side to create a roofing or composite floor structure. The following are the dimensions of one embodiment of the long-span decking panel as represented by the reference characters in FIGS. 1–3.

| | |
|---|---|
| A | 14 ½ in. |
| B | 13 11/16 in. |
| C | 7 ½ in. |
| D | 2 ¼ in. |
| E | 3 in. |
| F | 9/16 in. |
| G | 3/16 in. |
| H | 1 ½ in. |
| I | 36 in. |

In this embodiment the long-span decking panel 10 is comprised of 12 to 20 gage galvanized steel sheet. The seats, webs, and flange member are formed from one continuous piece of steel sheet. The reinforcing ribs 18 are roll pressed into the flange member which act to work harden it. The reinforcement ribs 18 by themselves allow the long-span decking panel 10 to be fully effective. While the reference characters represent but one embodiment, the long span decking panel is not limited thereto. For instance, C could also be 3, 4½ or 6 inches.

In this manner, each panel 10 will provide up to 50% greater coverage than typical long-span decking panels. The long-span decking panels 10 will be more economical to manufacture and will be more economical to install in the field. The long-span decking panels 10 will use less steel per unit of coverage than the prior art decking. Further, the wide space offered by the long-span decking panel 10 can be utilized for larger fixtures or HVAC ducts. The wider panels 10 will also be more aesthetically pleasing.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A long-span decking panel comprising:

a flange member having a first edge and a second edge extending the length of the flange member which are disposed at least 11 inches apart, said flange member having an essentially flat unbroken soffit except for a series of stiffening ribs running transverse to said first and second edges providing sufficient rigidity to prevent buckling of the flange member along its length during operation;

a first web member integrally joined and extending obliquely from said first edge;

a second web member integrally joined and extending obliquely from said second edge;

a first seated end extending from the first web member in a parallel relationship with the flange member; and a second seated end extending from the second web member in a parallel relationship with the flange member for engaging with a first seated end of an adjacent long-span decking panel.

2. A long-span decking panel as described in claim 1 wherein the stiffening ribs are pressed rounded embossments having a depth of at least ⅛ inch and are spaced no more than 1½ inches apart.

3. A long-span decking panel as described in claim 2 wherein the first and second web members extend from the flange member at an angle of 87°.

4. A long-span decking panel as described in claim 3 wherein the first seated end 15 has a smaller width than the second seated end so that it can seat within a second end of an adjacent long-span decking panel.

5. A decking structure comprising:

at least one long-span decking panel having a flange member including a first edge and a second edge extending the length of the flange member which are disposed at least 11 inches apart, said flange member having an essentially flat unbroken soffit except for a series of stiffening ribs running transverse to said first and second edges providing sufficient rigidity to prevent buckling of the flange during operation, said long-span decking panel further including first and second web members extending from said first and second edges respectively having first and second seated end portions respectively; and a base plate upon which the first and second seated end portions are fixedly mounted, said base plate including a third edge having a first projection extending therefrom and a fourth edge having a second projection extending therefrom for engaging with a first projection low of an adjacently disposed base panel.

6. A decking structure as described in claim 5 wherein two long-span decking panels are disposed upon the base plate.

7. A decking structure as described in claim 6 wherein the first projection is bent lap and the second projection is a strip for enveloping within said bent lap.

8. A decking structure as described in claim 7 wherein the stiffening ribs are pressed rounded embossments having a depth of at least ⅛ inch and are spaced no more than 1½ inches apart.

9. A long-span decking panel as described in claim 2 wherein the first and second web members extend from the flange member at an angle of 87°.

* * * * *